US005649377A

United States Patent [19]

Tanada

[11] Patent Number: 5,649,377

[45] Date of Patent: Jul. 22, 1997

[54] MULTIPURPOSE BUCKET STRUCTURE

[76] Inventor: Katsunori Tanada, 5-21, Nishimi 5-chome, Iwakuni, Japan

[21] Appl. No.: 237,874

[22] Filed: May 4, 1994

[30] Foreign Application Priority Data

May 5, 1993 [JP] Japan ..... 5-139784

[51] Int. Cl.[6] ..... E02F 3/96

[52] U.S. Cl. ..... 37/406; 37/903; 414/739

[58] Field of Search ..... 37/408, 409, 410, 37/461, 184, 187, 903, 185, 186, 188, 189, 468, 406; 91/420; 294/162; 414/722, 729–741

[56] References Cited

U.S. PATENT DOCUMENTS

| | | | |
|---|---|---|---|
| D. 159,160 | 6/1950 | Mork | 414/722 X |
| 827,635 | 7/1906 | Hone | 37/187 |
| 1,348,979 | 3/1932 | Stover et al. | 37/461 X |
| 2,328,715 | 9/1943 | Drott | 37/461 X |
| 3,252,606 | 5/1966 | Pryor | 37/406 X |
| 3,344,540 | 10/1967 | Ulrich | 37/406 |
| 3,461,968 | 8/1969 | Longley | 37/406 X |
| 3,578,188 | 5/1971 | Drieschner | 37/103 X |
| 3,737,059 | 6/1973 | Peterson et al. | 37/184 X |
| 3,767,070 | 10/1973 | Arnold | 37/406 |
| 3,881,263 | 5/1975 | Coeurderoy | 294/68.23 X |
| 3,941,262 | 3/1976 | Moser et al. | 214/145 |
| 4,283,866 | 8/1981 | Ogawa | 37/406 |
| 4,333,676 | 6/1982 | Thumm | 37/461 X |
| 4,375,345 | 3/1983 | Hanson | 414/722 |
| 4,542,929 | 9/1985 | Possinger | 37/186 X |
| 4,561,199 | 12/1985 | Lockwood | 37/903 X |
| 4,669,494 | 6/1987 | McBeth | 91/420 X |
| 4,779,364 | 10/1988 | Holmdal | 37/468 X |
| 5,140,760 | 8/1992 | Mannbro | 414/722 X |
| 5,163,352 | 11/1992 | Yoshino | 91/420 |
| 5,163,804 | 11/1992 | Kobayashi | 414/739 |
| 5,311,684 | 5/1994 | Van Dalfsen | 37/409 |
| 5,398,430 | 3/1995 | Scott et al. | 37/184 X |

*Primary Examiner*—Terry Lee Melius
*Assistant Examiner*—Victor Batson
*Attorney, Agent, or Firm*—Wenderoth, Lind & Ponack

[57] ABSTRACT

A multipurpose bucket structure can carry long materials, pull down a building into pieces and take away the pieces, disassembly an automobile and take away the parts, work with a large-sized tool, dig the ground, for put an area destroyed by a disaster in order, carry ready-mixed concrete and carry concrete blocks or secondary products of concrete. In the bucket structure, an openable bucket is attached in an openable manner to a body bucket by an actuating cylinder, and the buckets are formed with tooth portions for grasping materials. The bucket structure thus constructed of the body bucket and openable bucket can be swiveled in a plane normal to the opening and closing direction of the openable bucket. The openable bucket is automatically locked in its closed position and in any open angle position. On the other hand, the swivel mechanism is equipped with a locking mechanism for locking it in a swivel position.

10 Claims, 14 Drawing Sheets

MULTIPURPOSE BUCKET STRUCTURE

BACKGROUND OF THE INVENTION

1. Field of the Invention

The present invention relates to a multipurpose bucket structure to be attached to the leading end portion of an arm of a construction machine such as a power shovel.

2. Description of the Related Art

In the prior art, a working machine such as a construction machine or a power shovel can be used according to its function for construction work, such as a trench digging operation. Because of this simplified function, the machine cannot be sufficiently applied to a variety construction work.

For example, the power shovel of the prior art has a single bucket which is attached to a leading end portion of its arm, but is not equipped with any cover. Some power shovel are so modified as to have various attachments. In either case, the functions are so restricted that the working efficiency cannot be enhanced to meet the term of works.

SUMMARY OF THE INVENTION

Therefore, an object of the present invention is to provide a multipurpose bucket structure for carrying long materials, for pulling down a building into pieces and taking away the pieces, for disassembling an automobile and taking away the parts, for working with a large-sized tool, for digging the ground, for putting the area destroyed by a disaster in order, for carrying ready-mixed concrete and for carrying concrete blocks or secondary products of concrete.

Specifically, according to the present invention, there is provided a multipurpose bucket structure which comprises a body bucket forming an upper jaw and an openable bucket forming a lower jaw, wherein the buckets are so hinged to each other that their leading end portions can be opened and closed, and wherein each of the buckets have formed on their opening peripheral edge one or more tooth portions. With this construction, the bucket structure is enabled, with its openable bucket being opened, to dig like the prior art by its body bucket and to carry long materials by grasping them between the tooth portions of its leading end.

In a further feature of the invention, a gap is formed between the peripheral edge of the opening of the body bucket and the peripheral edge of the opening of the openable bucket to grasp long materials more easily, and is closed with a removable cover. In the closed state, the inside defined by the closed body and openable bucket is completely sealed in order to carry a fluid material such as cement mortar therein. Since the bucket structure can carry fluid materials such as cement milk, it is conceivable to place the concrete material in a form at the site for the foundation work.

According to the present invention, the pouring operation of the cement milk can be facilitated by forming a pouring port in the top portion of the body bucket.

According to the present invention, moreover, the opening and closing actions of the aforementioned body bucket and openable bucket are effected by an actuating cylinder, and the supply of working oil to the actuating cylinder can be remotely controlled from the body of the working vehicle. In this modification, moreover, the actuating cylinder is accommodated in a protecting box outside of the body bucket so that it can be protected not only against sand or other members but also a collision.

Furthermore, the working oil passage to the actuating cylinder is provided at a midway point with a lock valve for locking the actuating cylinder at a predetermined length. The lock valve is provided with a decompression valve for decompressing an abnormally high pressure to the actuating cylinder to release the locked state. Thus, it is possible to prevent the lock valve, the openable bucket or the body bucket from being broken when in an abnormal operation.

The pouring operation of the aforementioned cement milk can be facilitated by forming the pouring port in the top portion of the body bucket in accordance with the present invention. The aforementioned bucket structure, composed of the body bucket and the openable bucket according to the present invention, can be swiveled with respect to the mounting portion of the construction machine. As a result, the body bucket can be swiveled at an arbitrary angle so that the materials can be easily folded or cut by turning the body bucket while grasping the materials between the buckets.

According to the present invention, furthermore, the buckets are formed to have at least one of their back portions with a sloped flat wall portion in order to level placed concrete or the ground.

BRIEF DESCRIPTION OF THE DRAWINGS

A more detailed construction of the present invention and the effects obtained therefrom will become apparent from the following description, made with reference to the accompanying drawings, in which.

DESCRIPTION OF THE PREFERRED EMBODIMENTS

Figure 1:
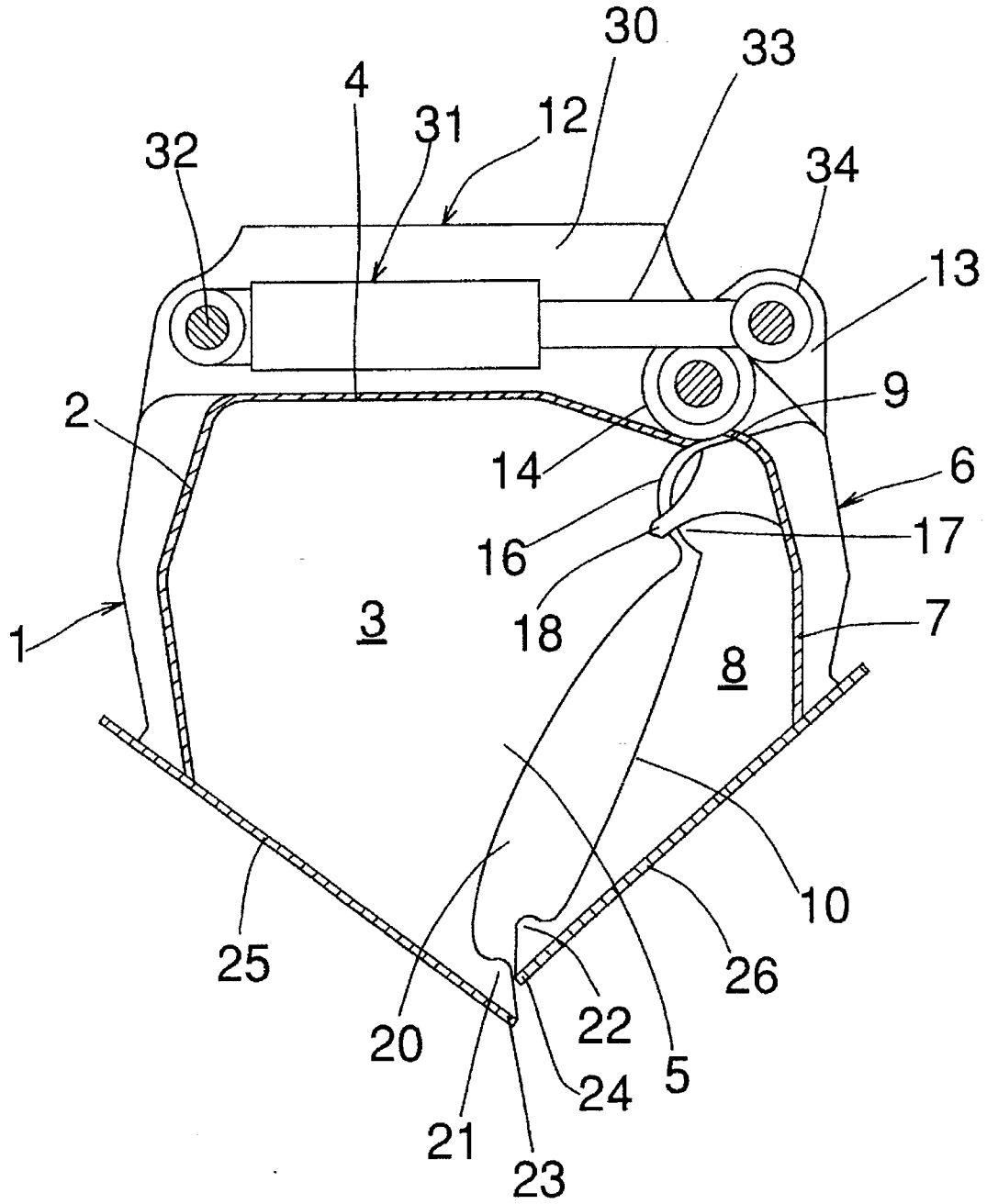
FIG. 1 is a side elevation of a bucket structure of the present invention and shows a body bucket and an openable bucket in vertical section.

In FIG. 1, reference numeral 1 designates a body bucket which is constructed of a back portion 2, righthand and lefthand side portions 3 and a top portion 4. The body bucket 1 is opened at 5 at its front portion opposed to the back portion 2. On the other hand, numeral 6 designates an openable bucket, which is also constructed of a back portion 7, righthand and lefthand side portions 8 and a top portion 9 and opened at 10 at its front portion. The body bucket and openable bucket 1 and 6 protrude from respective top portions 4 and 9 to form base portions 12 and 13. To the base portion 12 of the body bucket 1, in the vicinity of the opening 5, there is hinged, by means of a pin, the base portion 13 of the openable bucket 6, so that the openable portion 6 can be turned and opened on the hinge pin 14.

The body bucket 1 is formed, at the upper end portions of the side portions 3 on the peripheral edges of the opening 5, with a semicircularly recessed back tooth portion 16, which is faced by a semicircularly recessed back tooth portion 17 formed in the side portions 8 of the openable bucket 6 so that the two back tooth portions 16 and 17 can mesh with each other. Moreover, the openable bucket 6 is formed with a higher tooth portion 18 which is projected farther than the back tooth portion 17 so as to come into the opening 5 inside of the side portions 3 of the body bucket 1. The peripheral edges of the opening 5 below the individual back tooth portions 16 and 17 are individually gently recessed to establish a gap 20 between the side portions 3 and 8 of the body bucket 1 and the openable bucket 6. Furthermore, the side portions 3 and 8 are formed at their lower end portion below the gap 20 with projecting middle tooth portions 21 and 22, and the back portions 2 and 7 are formed at their leading end portions with front tooth portions 23 and 24 between the side portions 3 and 8.

The back portions 2 and 7 are inclined below their vertically intermediate portions toward the front tooth portions 23 and 24 to form flat plate portions 25 and 26 so that the two buckets 1 and 6 are sloped at the lower portions of their back portions. The inclined faces of the buckets contain an angle of 60° to 140° therebetween.

On the other hand, the upper base portion 12 of the body bucket 1 is composed of two righthand and lefthand side plates 30, between which a hydraulic cylinder 31 is horizontally arranged so as to be directed generally in parallel with the opening and closing directions. This hydraulic cylinder 31 has its bottom hinged to the portion just above the back portion 2 of the body bucket 1 at the side opposed to the hinge pin 14 of the openable bucket 6 by means of a hinge pin 32 fitted between the two side plates 30. The rod 33 of the hydraulic cylinder 31 has its leading end hinged to the base portion 13 of the openable bucket 6 through a joint pin 34 positioned above the aforementioned pin 14. Thus, the openable bucket 6 has its leading end turned downward to assume a closed position, as shown in FIG. 1, when the hydraulic cylinder 31 has its rod 33 extended, but assumes an open position when the rod 33 is contracted.

Figure 2:
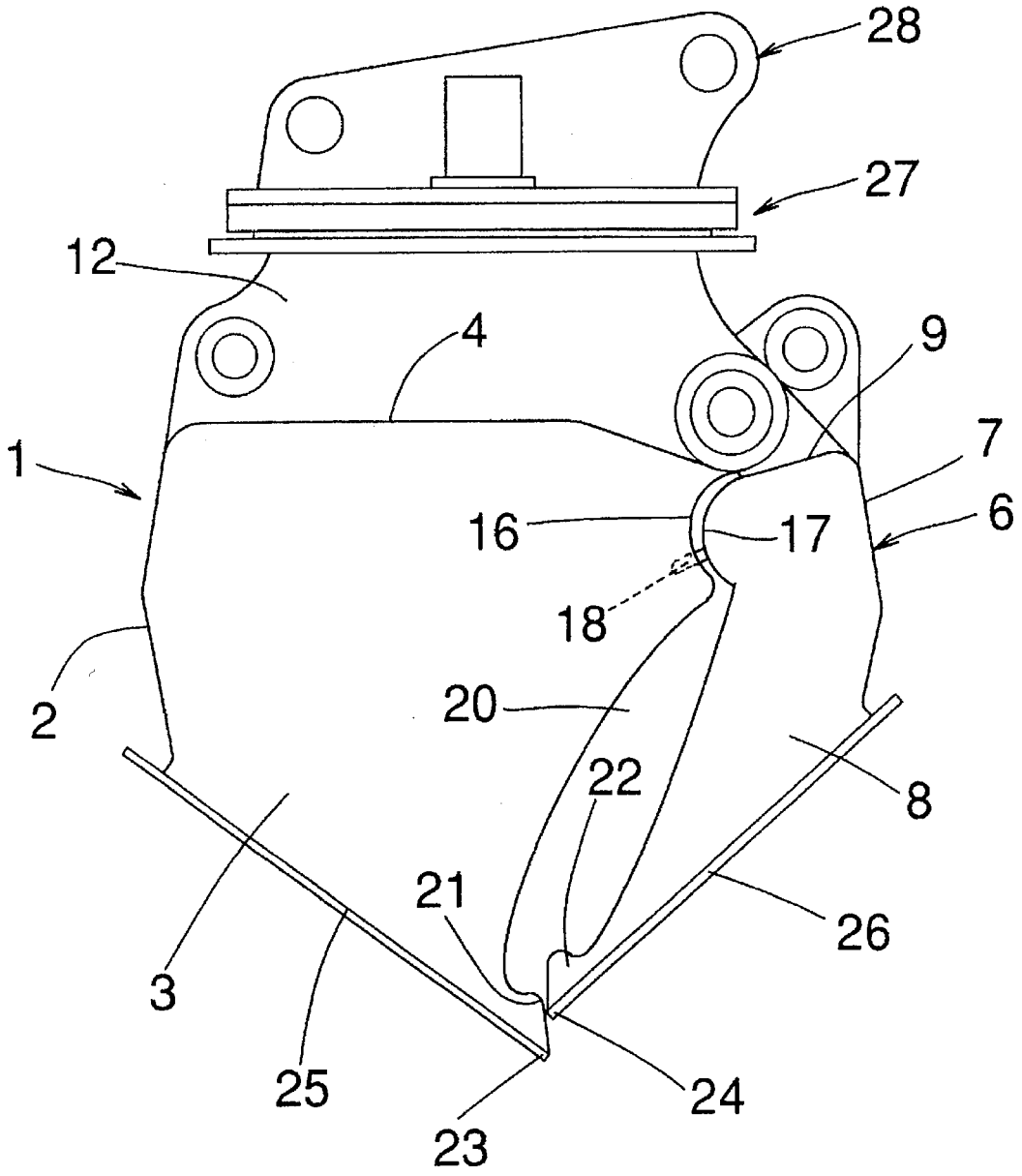
FIG. 2 is a side elevation showing the bucket structure of the present invention, in which the body portion of the bucket is pivotably attached.
Figure 3:
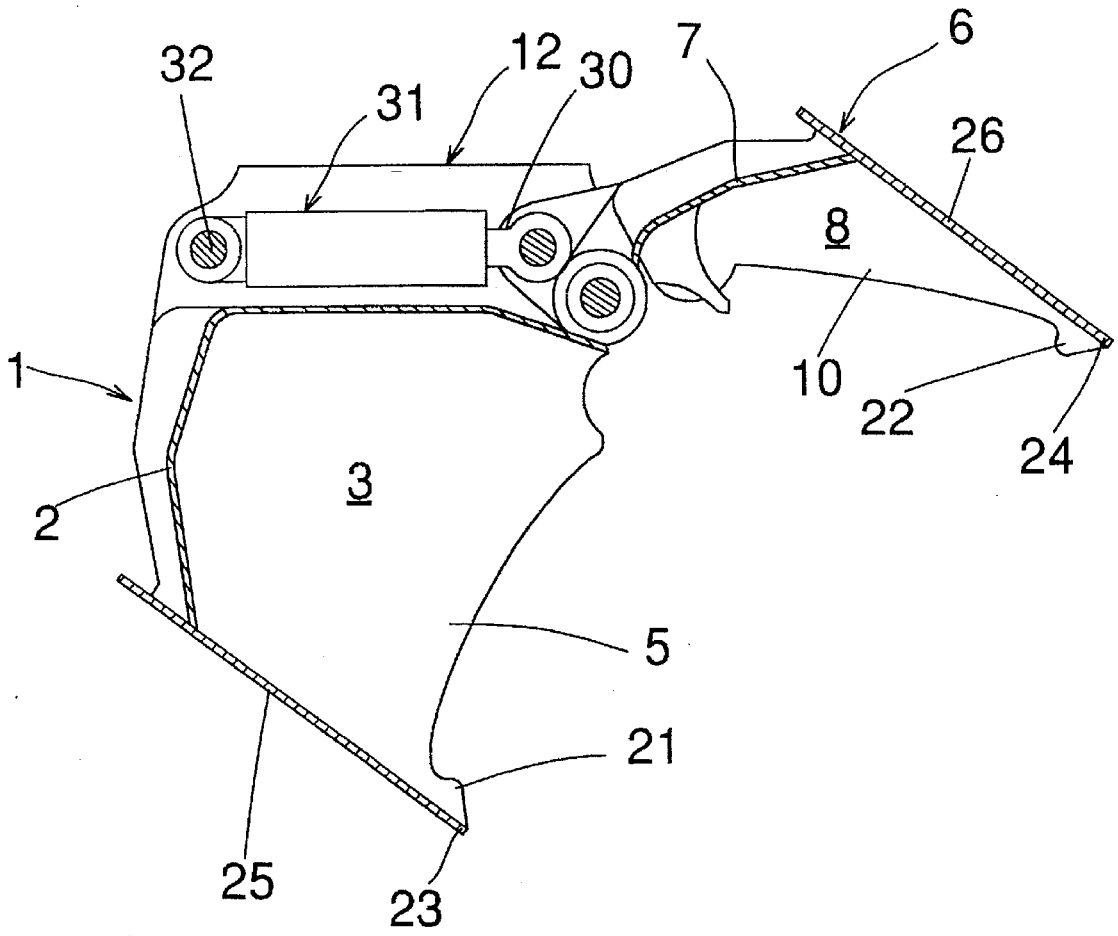
FIG. 3 is a vertical section showing an essential portion of the bucket structure of the present invention with an openable bucket being opened.
Figure 4:
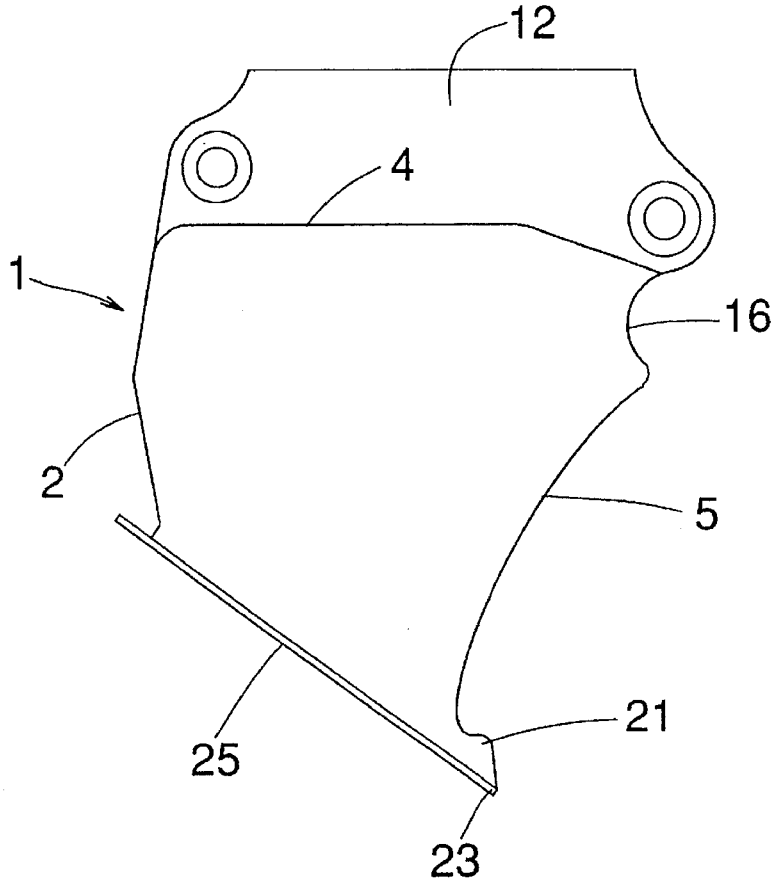
FIG. 4 is a side elevation showing the body bucket.
Figure 5:
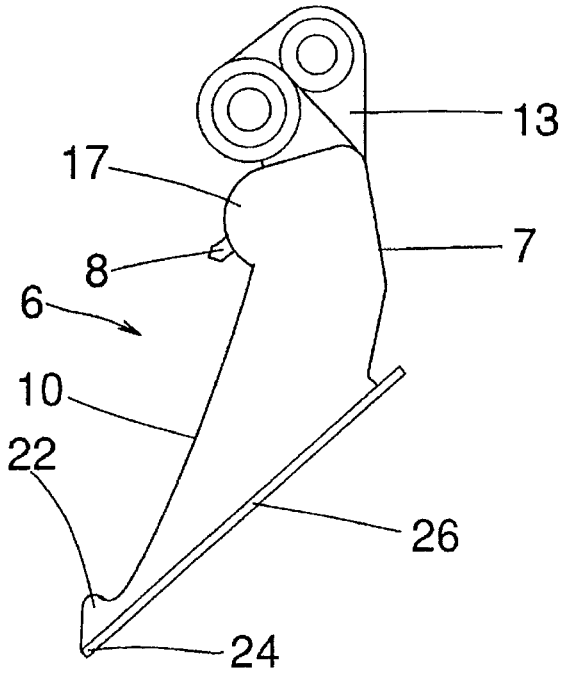
FIG. 5 is a side elevation showing the openable bucket.
Figure 6:
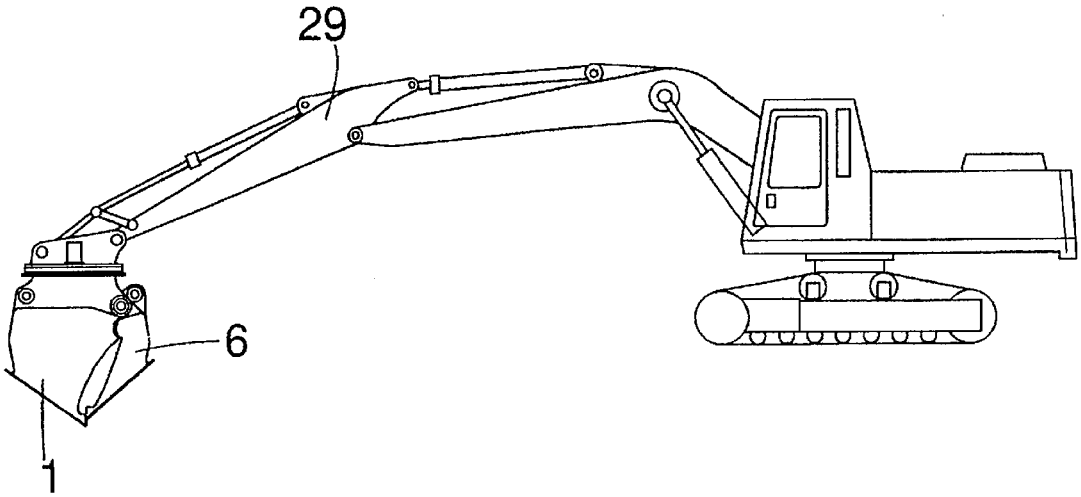
FIG. 6 is a side elevation showing the state in which the bucket structure of the present invention is attached to an arm of a working vehicle through a swivel mechanism.
Figure 7:
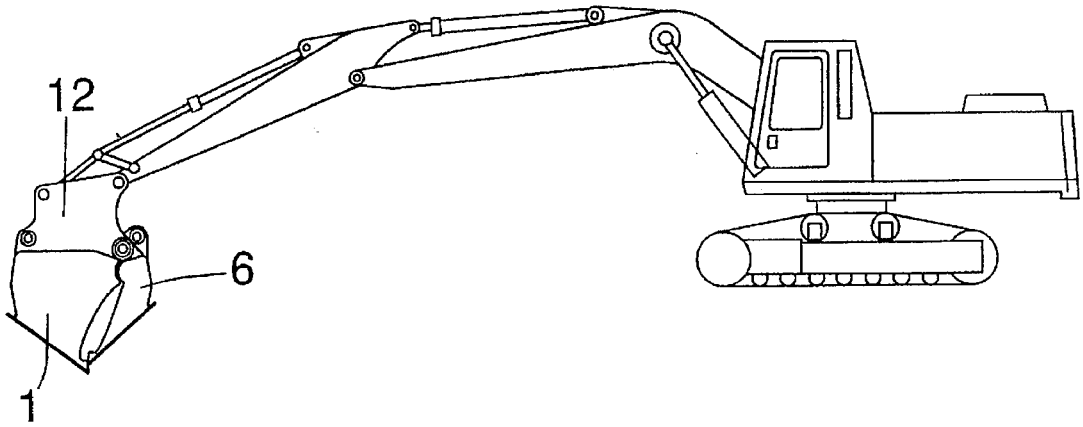
FIG. 7 is a side elevation showing the state in which the bucket structure of the present invention is attached to the arm of a working vehicle, but not through the swivel mechanism.

In FIG. 2, to the upper portion of the base portion 12 at the upper end of the body bucket 1, there is attached, through a swivel mechanism 27, a mounting base 28 for a working vehicle. Specifically, this mounting base 28 is attached to a leading end of a arm 29 of the working vehicle, as shown in FIG. 6, so that a bucket structure composed of the body bucket 1 and the openable bucket 6 can be swiveled by 360 degrees with respect to that arm 29. Incidentally, FIG. 7 shows the case in which the bucket structure is attached to the arm 29, but not through the aforementioned swivel mechanism 27.

FIGS. 8 to 14 show another embodiment of the present invention. First of all, the body bucket 1 is formed in the upper face of its top portion 4 with a pouring port 35 for pouring a fluid material for construction, such as cement milk. This pouring port 35 is surrounded by a funnel portion 36, which has a sloped upper face. Moreover, the aforementioned gap 20 between the side portions 3 and 8 of the body bucket 1 and the openable bucket 6 is closed by a cover plate 38, which is removably fastened to the side portions 8 in the vicinity of the opening of the openable bucket 6 by means of three bolts 37. While the openable bucket 6 is being closed, the cover plate 38 has its leading end closely abutting the end portion of the side portions 3 of the body bucket 1. As result, the fluid material is prevented from overflowing from the gap 20 when it is poured from the aforementioned pouring port 35 or scooped up.

In the bucket structure of this embodiment, moreover, there are added edge members 40 for forming the aforementioned front tooth portions 23 and 24 of FIG. 1. The edge members 40 are formed above the front tooth portions 23 and 24 with slightly recessed portions 41 and 41.

Figure 10:
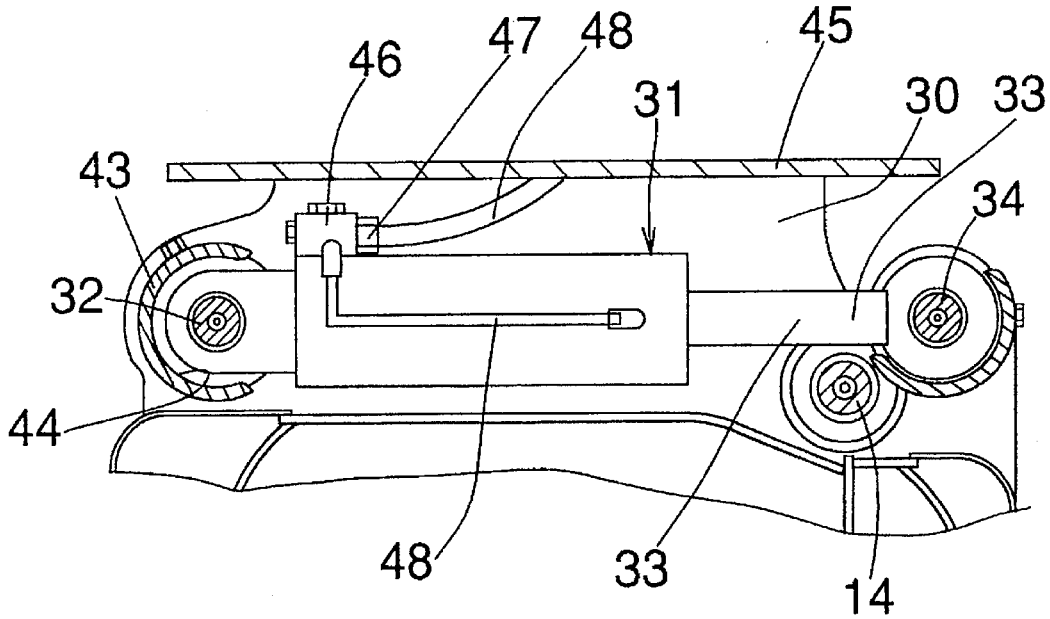
FIG. 10 is a side elevation of an essential portion showing an actuating cylinder accommodating box portion of the bucket structure of FIG. 1 in vertical section.
Figure 11:
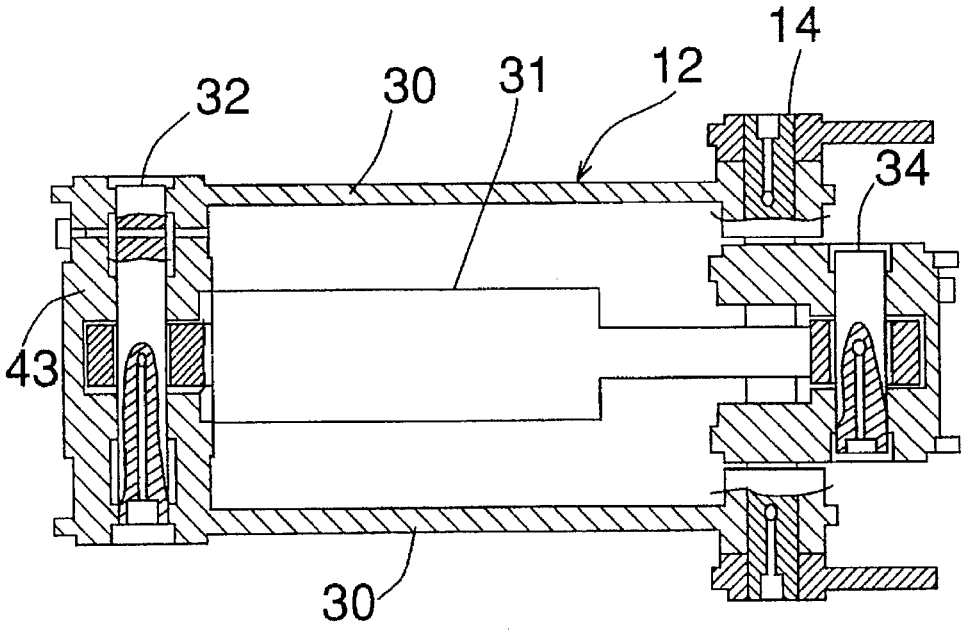
FIG. 11 is a top plan view showing the actuating cylinder accommodating portion of FIG. 10 in horizontal section.

As shown in FIGS. 10 and 11, the pin 32 supporting the bottom side of the hydraulic cylinder 31 is inserted into a pin bearing hole 44, which is formed in a joint portion 43 integrally formed between the side plates 30. The joint portion 43 is constructed to plug the bottom-side opening of the hydraulic cylinder 31 to prevent invasion of sand as much as possible. To the upper end portion of the side plates 30, moreover, there is attached a horizontal mounting plate 45 so as to close the open portion between the side plates 30. Thus, the side plates 30, the joint portion 43 and the mounting plate 45 constitute altogether a box for protecting the hydraulic cylinder 31. The ratio of the distance from the hinged portion for hinging the openable bucket to the hinged portion of the actuating cylinder to the openable bucket to the distance from the hinged portion for hinging the openable bucket to the hinged portion of the actuating cylinder to the body bucket is set to 1:4 to 1:9.

Above the cylinder portion of the hydraulic cylinder 31, there is mounted a lock valve 46, which is equipped with a decompression mechanism for holding the hydraulic cylinder 31 at a predetermined extension. Numeral 48 designates an oil pressure piping to the hydraulic cylinder 31. This hydraulic cylinder 31 can be used for various work by replacing the openable bucket with another attachment.

Figure 9:
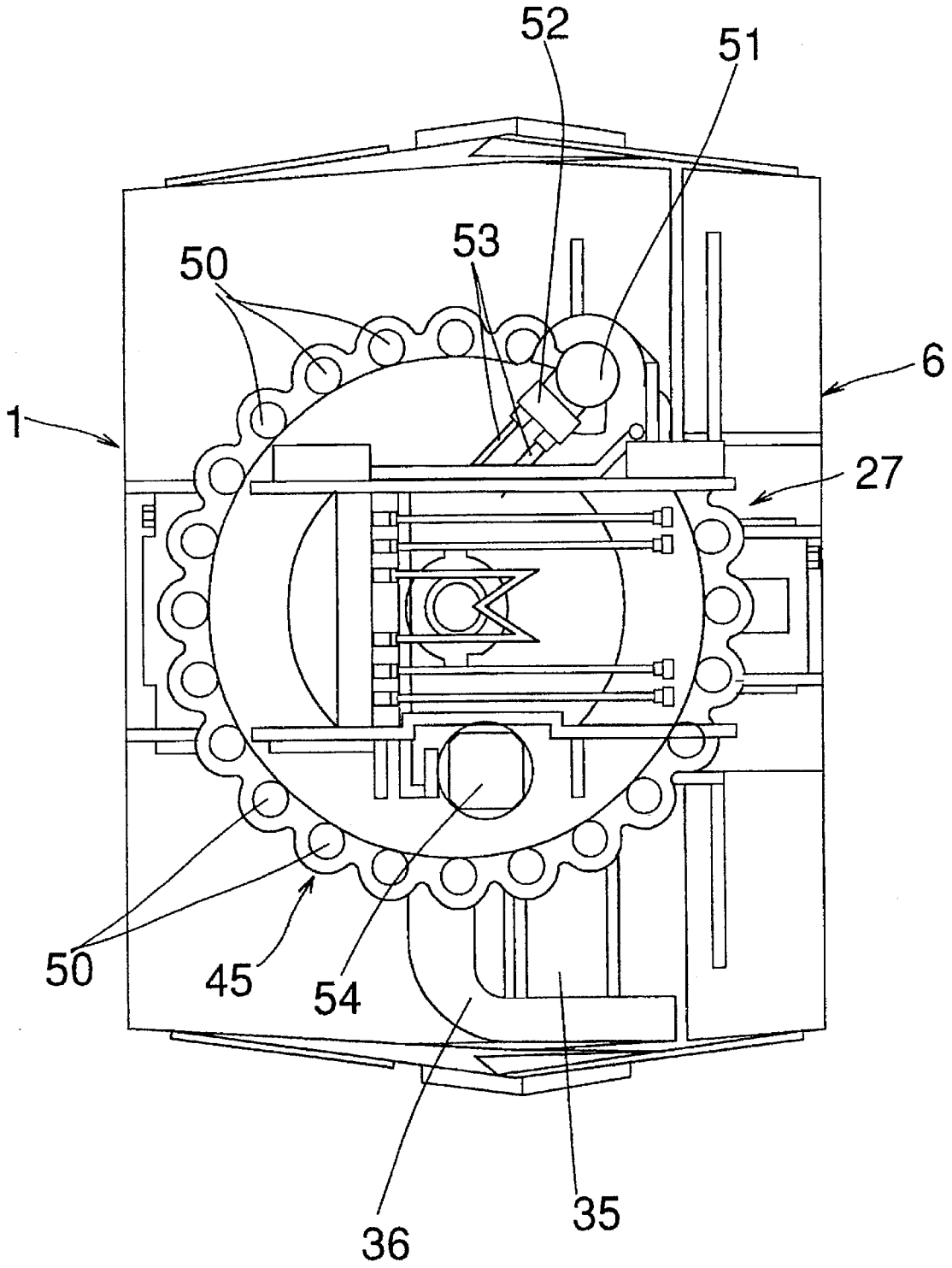
FIG. 9 is a top plan view showing the bucket structure of FIG. 8.

The aforementioned mounting plate 45 has a round shape, as seen from the top plan view of FIG. 9, and is formed along its outer circumference with a number of lock holes 50. To the swivel portion of the aforementioned swivel mechanism 27, there is accordingly attached a lock cylinder 51 which can have its rod inserted into one of the lock holes 50 to lock the aforementioned bucket structure in a horizontally swiveled arbitrary position. Numeral 52 designates a relief valve which is disposed midway in oil pressure piping 53 to the lock cylinder 51.

Figure 8:
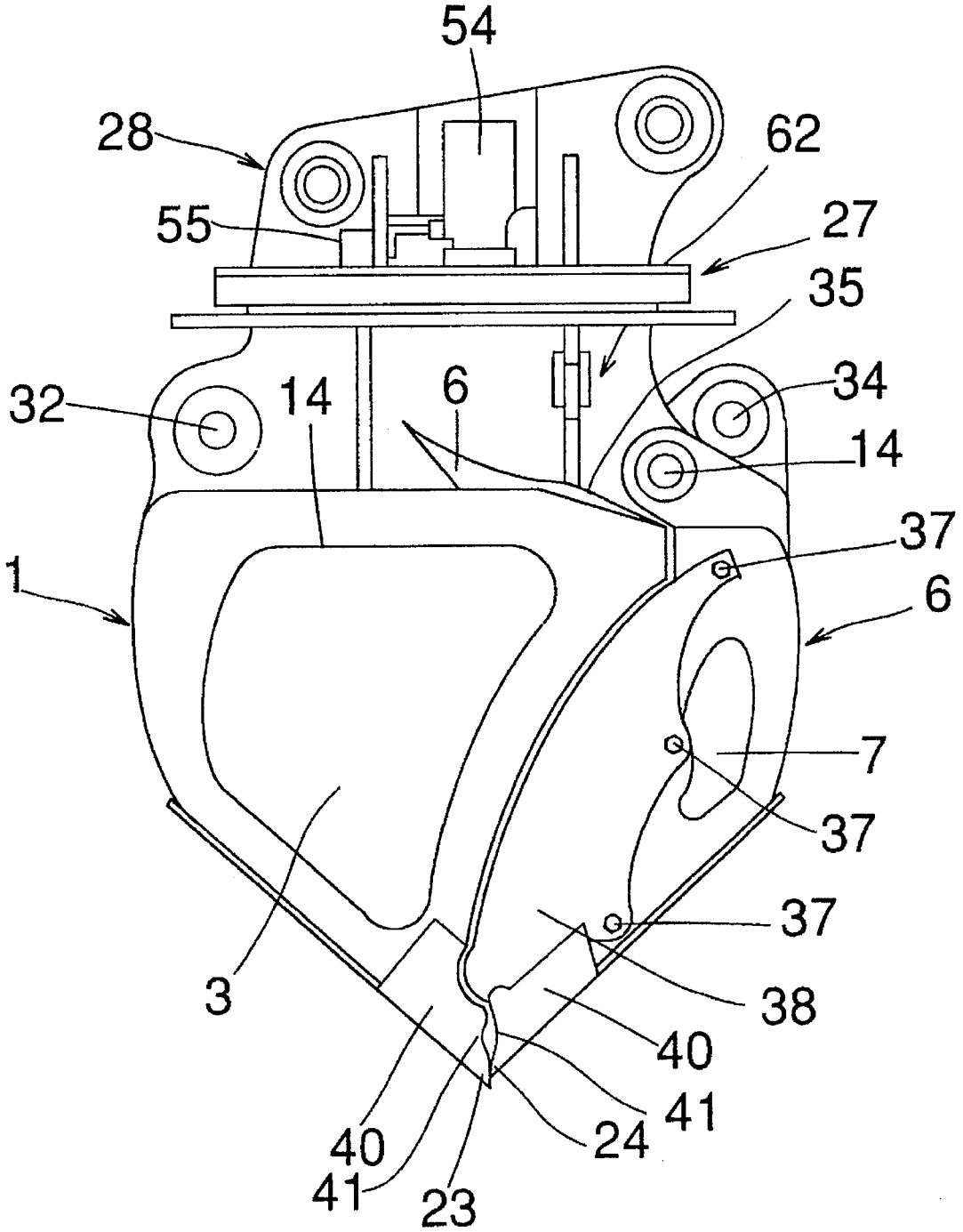
FIG. 8 is a side elevation showing a bucket structure according to another embodiment of the present invention.
Figure 12:
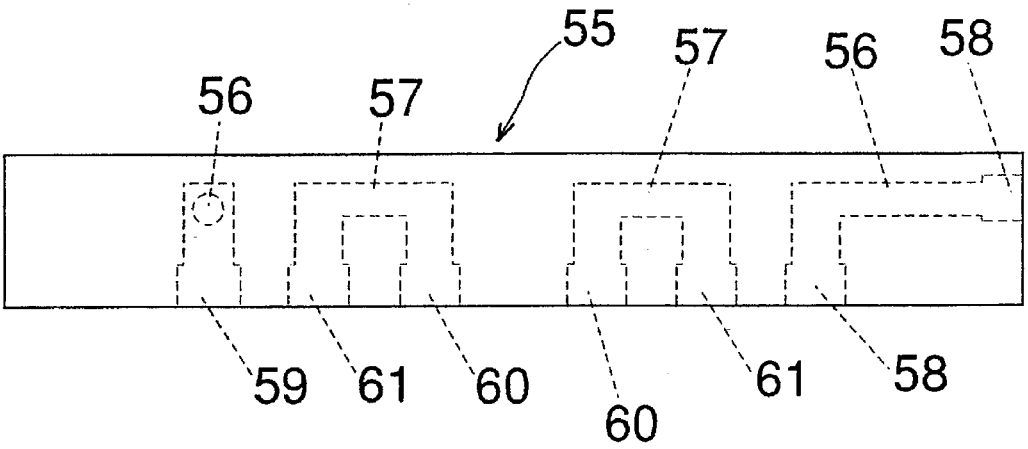
FIG. 12 is a side elevation of a piping case.
Figure 13:
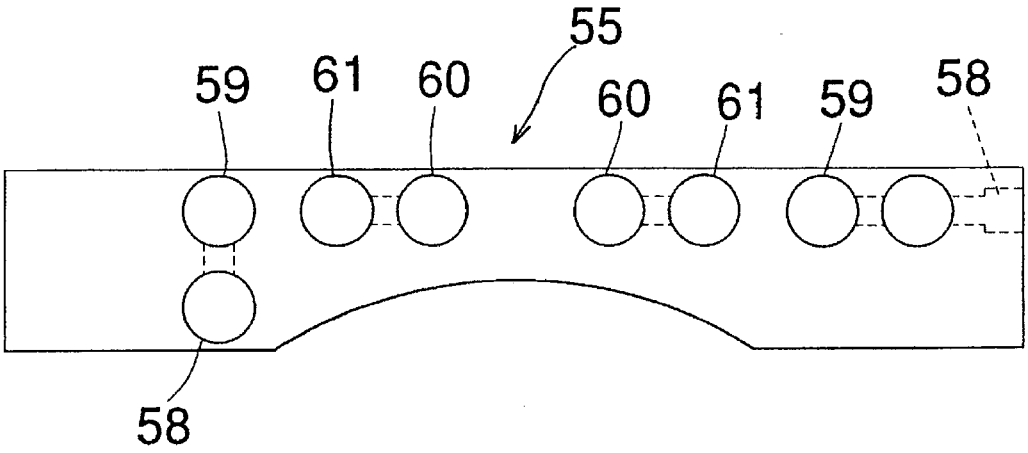
FIG. 13 is a front elevation showing the piping case.

In FIG. 8, numeral 55 designates a piping case disposed in one portion of the aforementioned mounting base 28. This piping case 55 is equipped with oil passages 56 for a swiveling hydraulic motor 54 and oil passages 57 for a hydraulic cylinder, as shown in FIGS. 12 and 13. The oil passages 56 have one port 58 connected with the piping of the lock cylinder 51 and their other port 59 connected with the piping of a hydraulic motor. This swiveling hydraulic motor 54 is mounted on the swivel mechanism 27, as shown in FIG. 8, to drive it in swiveling motion. The cylinder oil passage 57 has one port 60 connected with one chamber of the hydraulic cylinder 31 through a rotary joint (not shown) and an other port 61 connected with the not-shown piping (not shown) of the hydraulic pump.

Figure 14:
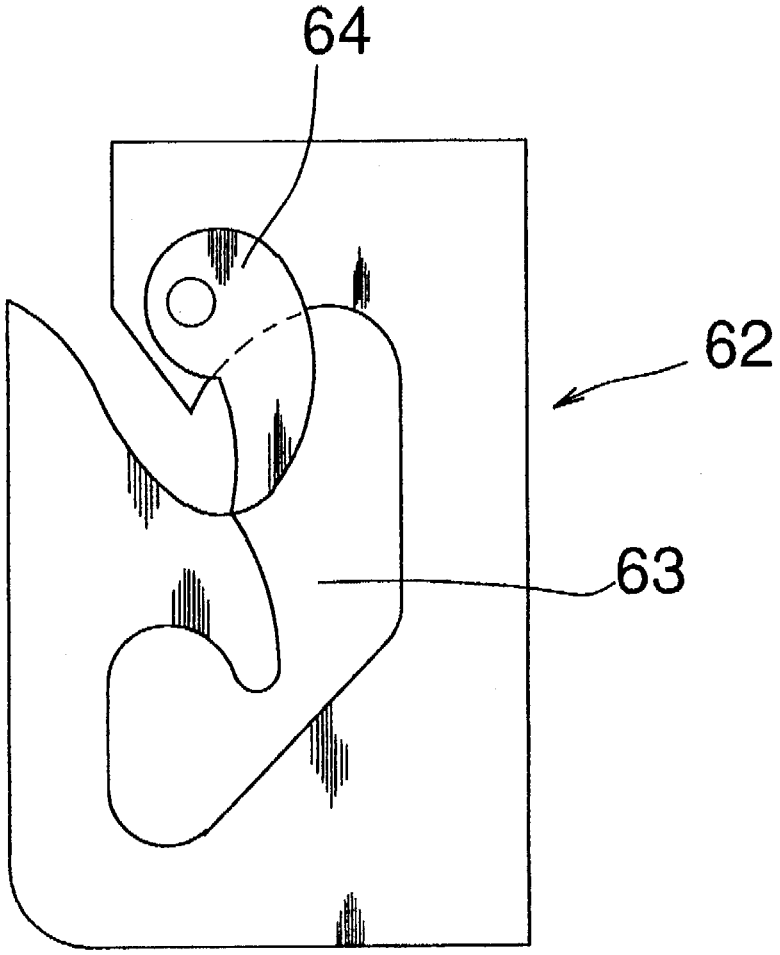
FIG. 14 is a side elevation showing a retaining hook to be attached to a side of the body bucket.

FIG. 14 shows a side of a retaining portion for a suspension hook, which is attached to the outer face of one base portion 12 above the body bucket 1. This suspension hook retaining portion 62 is composed of a groove 63 for inserting a hook and a lock lever 64 made turnable to close one portion of the groove 63. The retaining portion 62 thus composed has its lock lever 64 turned outward and prevented from coming out when the hook or the like is fitted in the groove 63.

Figure 15:
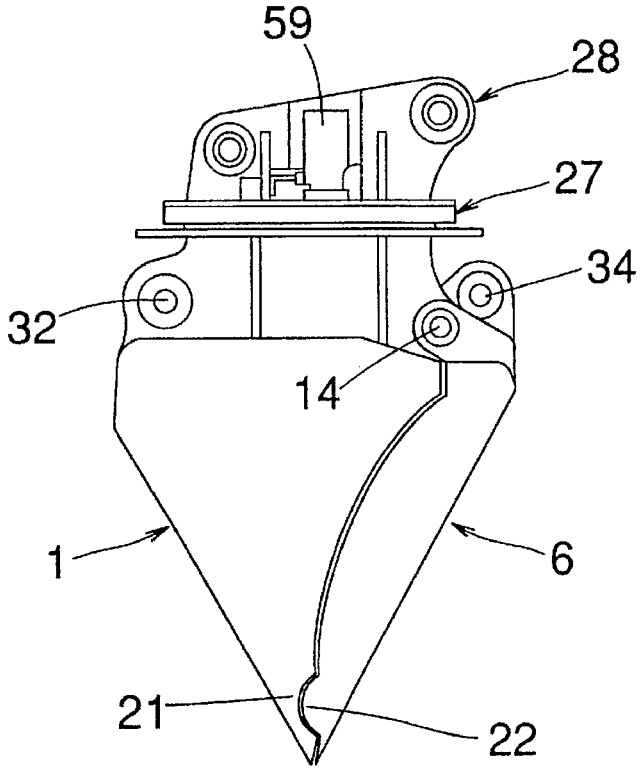
FIG. 15 is a side elevation showing a bucket structure according to still another embodiment of the present invention.
Figure 16:
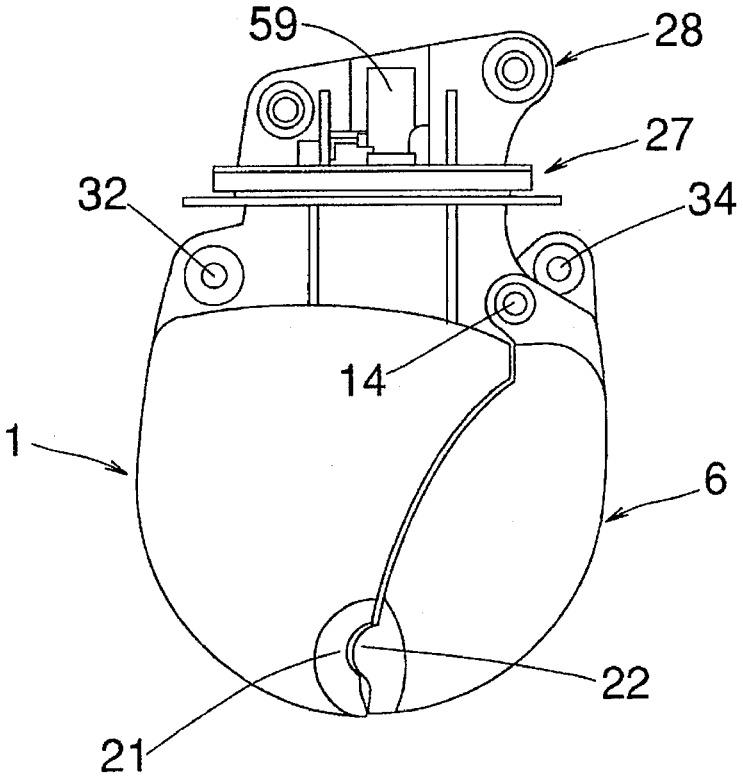
FIG. 16 is a side elevation showing a modification of the bucket structure of FIG. 15.

FIGS. 15 and 16 show a bucket structure according to another embodiment. In this embodiment, the respective side portions of the body bucket 1 and the openable bucket 6 are formed with the middle tooth portions 21 and 22, one of which is recessed whereas the other of which is projected. As shown in FIG. 16, the edge members 40 are attached for forming those middle tooth portions 21 and 22. Moreover, the body bucket 1 and the openable bucket 6 of FIG. 16 are not formed with the sloped side portions, but have their back portions bulging outward.

Figure 17:
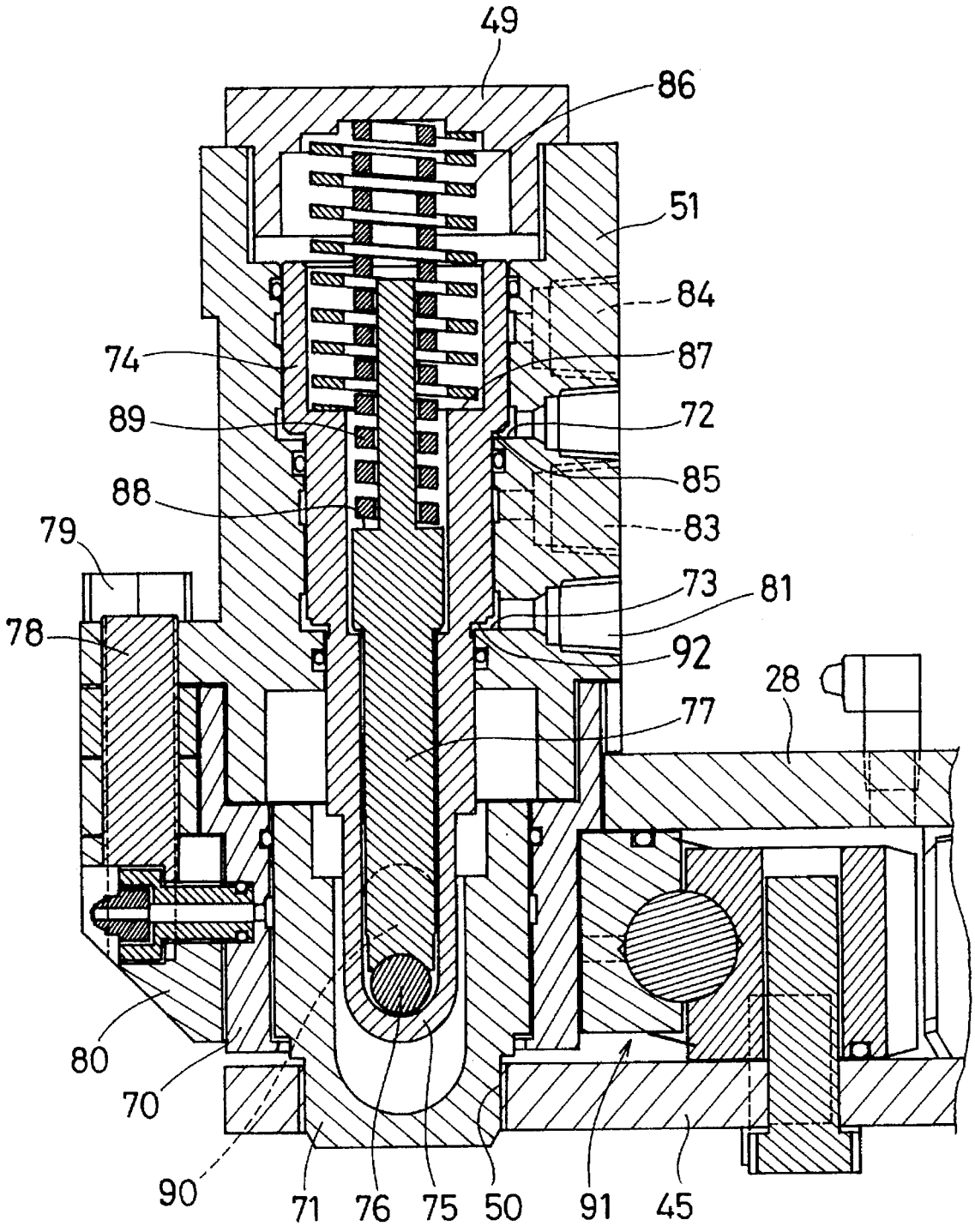
FIG. 17 is a longitudinal section showing a swivel locking mechanism.

FIG. 17 shows the aforementioned swivel locking mechanism in detail. On the outer circumference of the mounting base 28, there is mounted a cylindrical lock pin guide 70, into which is vertically movably inserted a lock pin 71. This lock pin 71 has its lower end inserted into one of the lock holes 50 of the aforementioned mounting plate 45, to lock the swiveling motion of the mounting plate 45. The lock pin guide 70 has its internal diameter enlarged at its upper end. Into this enlarged portion, there is inserted the lower end of the aforementioned lock cylinder 51. This lock cylinder 51 has its internal diameter gradually reduced at an upward first step portion 72 and an upward second step portion 73 positioned below the former. Into this lock cylinder 51, there is inserted a first piston 74, which is formed on its outer circumference with downward step portions 85 and 92 for abutting against the aforementioned step portions 72 and 73. The first piston 74 has a cylindrical shape having a bottom portion 75 at its lower end. Diametrically through the first piston 74, there is inserted a pin-push pin 76 as to abut against the inner face of the bottom portion 75. This pin-push pin 76 has its two ends extending through a vertically long bore 90, which is formed in the circumferential wall of the first piston 74, and fixed by the aforementioned lock pin 71. Into the first piston 74, moreover, there is downwardly inserted a rod-shaped second piston 77 so as to have its lower end abutting against the aforementioned pin-push pin 76. A flange 78 formed on the outer circumference of the cylinder 51 is fixed on the aforementioned mounting base 28 by means of downwardly inserted bolts 79. These bolts 79 have their leading ends driven into a support member 80 positioned below the mounting base 28. The lock cylinder 51 has its upper end opening closed by a spring seat 49. Moreover, a first spring 86 is mounted between the back of the spring seat 49 and an inward step portion 87 of the aforementioned first piston 74, and a second spring 89 is mounted between the back of the spring seat 49 and a spring receiving step portion 88 on the outer circumference of the second piston 77.

At the same time, the lock cylinder 51 is formed on its outer circumference with inlet ports 81 and 82 for feeding working oil to the upper portions of the aforementioned first and second step portions 72 and 73, and outlet ports 83 and 84 above and for the inlet ports 81 and 82. Specifically, when the working fluid is fed from the inlet ports 81 and 82, its pressure acts upon the individual step portions 85 and 92 of the first piston 74 to lift the first piston 74 against the force of the first spring 86. As the first pin 74 rises, the lock pin 71 is pulled upward through the pin-push pin 76 to release the locked state. Simultaneously with this, the second piston 77 is also lifted against the force of the second spring 89. When the first piston 74 rises to a predetermined position, the inlet ports 81 and 82 acquire communication with the outlet ports 83 and 84, respectively, so that the working oil is fed from the outlet ports 83 and 84 to the aforementioned swivel cylinder. When the feed of the working oil is interrupted, the swiveling motion is also interrupted so that the first piston 74 is pushed back by the individual forces of the springs 86 and 89 to bring the lock pin 71 into one of the lock holes 50 to effect the swivel lock. At this time, the first piston 74 can move downward ahead of the second piston 77 within a range of the long bore 90 so that a quick locking action can be achieved. Thus, the swivel mechanism is automatically locked and unlocked in accordance with the feed and interruption of the working oil to the swivel motor. Incidentally, numeral 91 designates a bearing for guiding the turning motion of the mounting plate 45.

Figure 18:
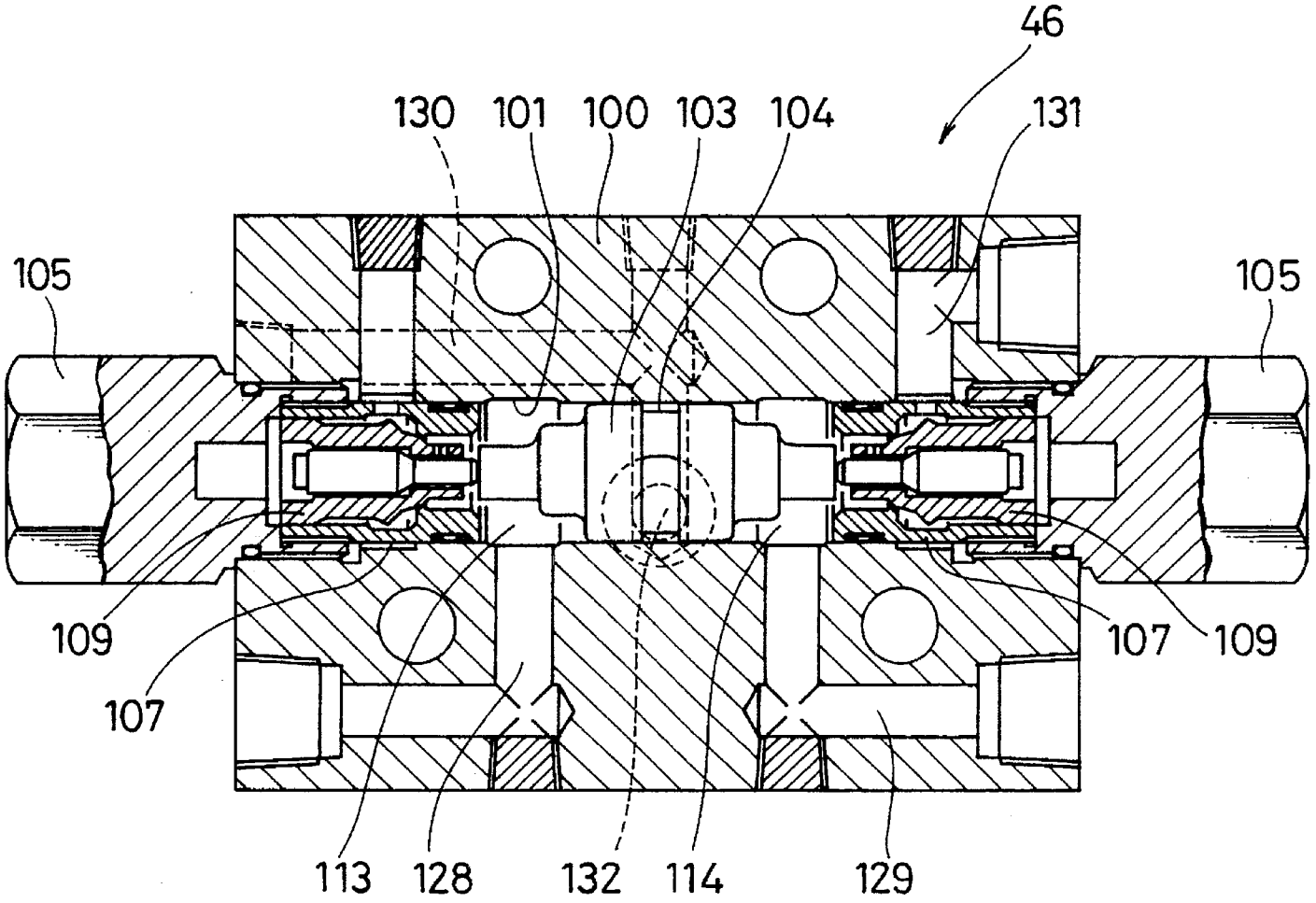
FIG. 18 is a longitudinal section showing the entirety of a lock valve with a decompression mechanism.
Figure 19:
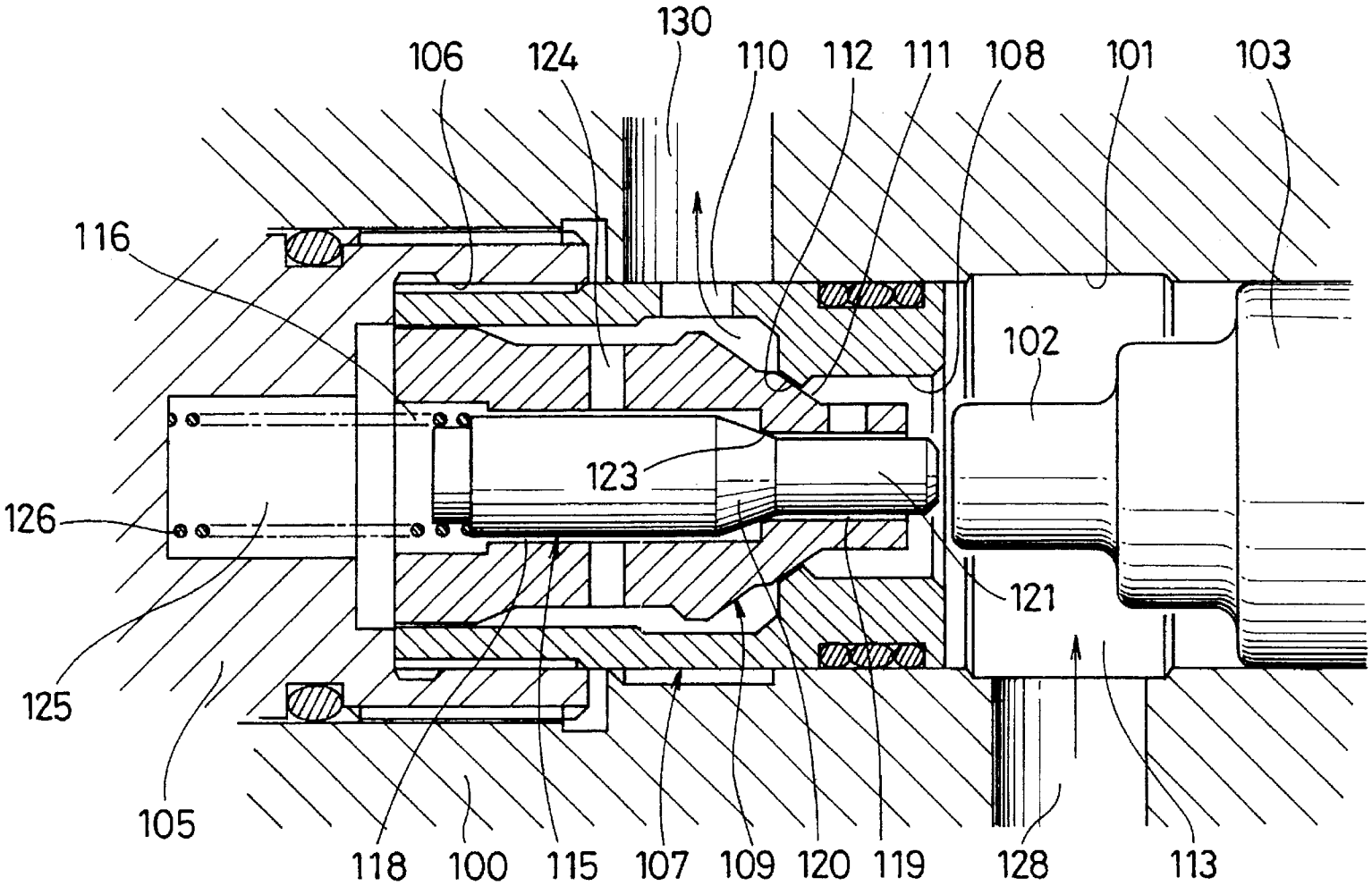
FIG. 19 is an enlarged section showing an essential portion of FIG. 18.

FIGS. 18 and 19 show a structure of the lock valve 46 with a decompression mechanism for locking the aforementioned hydraulic cylinder 31.

At the center in a valve fitting bore 101 extending through a valve cylinder 100 to the right and left of FIGS. 18 and 19, there is slidably fitted a main piston 103, which is formed with projections at its two ends. The valve fitting bore 101 has its two end openings closed with bolts 105 fastened therein. Into a threaded hole 106 at the leading end of each mounting bolt 105, there is driven one end of a cylindrical casing 107 so that the main piston 103 is fitted in the aforementioned bore 101. The casing 107 is radially reduced at the end opposed to the bolt 105. Into the inside of the reduced portion 108, there is fitted a valve body 109 which has its outer circumference tapered at its intermediate portion. The casing 107 is formed in a position corresponding to the outer circumference of the valve body 109 with a communication hole 110 for providing communication between the inside and outside of the casing 107. On the other hand, the tapered portion has an outer circumference 111 abutting against a valve seat 112 at the inner end of the reduced portion 108 of the casing 107 to break the communication between the aforementioned communication hole 110 and oil pressure chambers 113 and 114 at the two sides of the main piston 103.

Into a through hole 116 formed longitudinally of the valve body 109, there is fitted a smaller piston 115 which has its outer circumference formed into two larger and smaller portions across a longitudinally tapered portion 120. The smaller piston 115 has its smaller portion 121 protruded from the leading end of the valve body 109. On the other hand, the valve body 109 has its through hole 116 formed into two larger and smaller portions corresponding to the external diameters of the smaller piston 115, to leave small clearances 118 and 119 between itself and the smaller piston 115. The aforementioned tapered portion 120 is held in abutment against a valve seat 123 at the inner end of the smaller portion. The valve body 109 is formed with a communication hole 124 for providing communication between the aforementioned communication hole 110 and the clearance 118 around the outer circumference of the larger portion of the smaller piston 115. Between a spring fitting hole 125 formed in the bottom of the threaded hole 106 of the mounting bolt 105 and the inner end of the smaller piston 115, moreover, there is mounted a spring 126 for pushing the tapered portion 120 of the smaller piston 115 to the aforementioned valve seat 123.

The valve cylinder 100 is formed with two inlet passages 128 and 129 which are connected to the aforementioned oil pressure chambers 113 and 114, respectively, for introducing working oil from a working oil pump into the oil pressure chambers 113 and 114. The valve cylinder 100 is further formed with a pair of outlet passages 130 and 131 which are connected with the communication hole 110 of the aforementioned casing 107 for introducing the working oil from the communication hole 110 to the bottom and rod of the aforementioned hydraulic cylinder 31. Of these, one outlet passage 130 communicating with the lefthand oil pressure chamber 114 is bypassed in a hook shape to communicate with the outside through an outlet port 132 which is formed in the back at the center of the main piston 103.

In the construction thus made, one inlet passage 129 is used for feeding the working oil to the bottom side of the hydraulic cylinder 31, whereas the other inlet passage 128 is used for feeding the working oil to the rod side of the same. Thus, the working oil enters, when fed from its pump to the inlet passage 129 at the bottom side, to the corresponding oil pressure chamber 114. The pressure of the working oil thus fed to the oil pressure chamber 114 slides the main piston 103 to the left of the drawings so that the projection 102 at the leading end of the main piston 115 pushes and moves the smaller piston 103, as shown in FIG. 19, to the left in the drawings. As a result, the tapered portion 120 leaves the valve seat 123 of the valve body 109 so that the outlet passage 130 comes into communication with the oil pressure chamber 113 through the clearances 118 and 119 around the outer circumference of the smaller piston 115 and through the communication holes 124 and 110. As a result, the working oil at the rod side is relieved to the drain side to release the pressure of the rod side chamber gradually.

Next, the valve body 109 is pushed and moved in the same direction by the main piston 103 so that it leaves the valve seat 112 of the casing 107 to drain out the working oil of the rod side chamber substantially. Thus, the substantial release of the working oil is not carried out before the working oil in the bottom side chamber or the rod side chamber is slightly returned to the drain side. As a result, there can be achieved an advantage in that the openable bucket does not start its opening or closing action abruptly, but has its operation simplified.

On the other hand, the working oil having entered the oil pressure chamber 114 at the bottom side slides the valve body 109 at the bottom side to the right in the drawings so that the communication between the inlet passage 129 and the outlet passage 131 is established through the communication hole 110 to feed the working oil to the bottom side of the hydraulic cylinder 31. As a result, the hydraulic cylinder 31 is extended while discharging the working oil of the rod side by the pressure at the bottom side thereby to open the aforementioned openable bucket 6. In a neutral state in which the working oil is fed to neither of the inlet passage 128 and 129, moreover, the valve body 109 is held in the original position by the force of the spring 126 so that any passage is shut out to lock the openable bucket 6 in its open state.

Although the present invention has been described hereinbefore in connection with its preferred embodiments, it can be modified in various manners within the scope of the appended claims. It should be noted that the present invention should not preclude those modifications.

What is claimed is:

1. A multipurpose bucket structure comprising:

a body bucket forming an upper bucket jaw, said body bucket having a first leading end portion and first peripheral edges; and an openable bucket forming a lower jaw, said openable bucket having a second leading end portion and second peripheral edges; wherein said openable bucket is hinged to said body bucket such that said body bucket and said openable bucket are openable and closeable relative to each other;

wherein a gap is formed between said first peripheral edges and said second peripheral edges when said body bucket and said openable bucket are closed relative to each other; and wherein said gap is closed by a cover removably attached to at least one of said body bucket and said openable bucket when said body bucket and said openable bucket are closed relative to each other.

2. The multipurpose bucket structure of claim 1, wherein said body bucket comprises a top portion, a back portion connected with said top portion and side portions connected with said top portion and said back portion, said side portions having said first peripheral edges thereon, and wherein said openable bucket comprises a top portion, a back portion connected with said top portion and side portions connected with said top portion and said back portion, said side portions having said second peripheral edges thereon.

3. The multipurpose bucket structure of claim 2, wherein said cover is a plate removably attached to one of said body bucket and said openable bucket having a leading end abutting the peripheral edge of the other one of said body bucket and said openable bucket when said body bucket and said openable bucket are closed, said leading end portions being in contact with each other when said body bucket and said openable bucket are closed.

4. The multipurpose bucket structure of claim 3, wherein said plate is removably attached to the one of said body bucket and said openable bucket by bolts.

5. The multipurpose bucket structure of claim 1, wherein said cover is removably attached to at least one of said body bucket and said openable bucket by bolts.

6. A multipurpose bucket structure comprising:

a body bucket forming an upper bucket jaw, said body bucket including a top portion and a first leading end portion; and an openable bucket forming a lower jaw, said openable bucket having a second leading end portion;

wherein said openable bucket is hinged to said body bucket such that said body bucket and said openable bucket are openable and closeable relative to each other, said leading end portions being in engagement with each other when said body bucket and said openable bucket are closed relative to each other; and wherein said top portion of said body bucket has a pouring opening therein for pouring fluid cement mortar therefrom for construction.

7. The multipurpose bucket structure of claim 6, wherein said body bucket further comprises a back portion connected with said top portion and side portions connected with said top portion and said back portion and wherein said openable bucket comprises a top portion, a back portion connected with said top portion and side portions connected with said top portion and said back portion.

8. The multipurpose bucket structure of claim 6, wherein said top portion further comprises a funnel portion having an inclined wall formed around said pouring opening.

9. A multipurpose bucket structure comprising:

a body bucket comprising an upper base portion and forming an upper bucket jaw fixed with said upper base portion, said body bucket including a first leading end portion; and an openable bucket forming a lower jaw, said openable bucket having a second leading end portion;

wherein said openable bucket is hinged to said body bucket such that said body bucket and said openable bucket are openable and closeable relative to each other in a first plane, said leading end portions being in engagement with each other when said body bucket and said openable bucket are closed relative to each other; and wherein said body bucket has a swivel mechanism directly connected to said upper base portion thereof, said swivel mechanism comprising means for swivelling said body bucket in a second plane perpendicular to said first plane 360 degrees; and wherein said upper base portion further comprises a plurality of lock holes and said swivel mechanism further comprises a lock pin for locking said body bucket in a swivelled position by engaging one of said lock holes of said upper base portion;

wherein said swivel mechanism further comprises an oil pressure circuit leading to said swiveling hydraulic motor and a swivel lock mechanism in said oil pressure circuit; and wherein said swivel mechanism comprises a lock cylinder for causing a locking motion of said locking pin in accordance with the feed and interruption of working oil to said swiveling hydraulic motor.

10. A multipurpose bucket structure comprising:

a body bucket forming an upper bucket jaw, said body bucket including a top portion fixed to and above said upper bucket jaw and a first leading end portion;

an openable bucket forming a lower jaw, said openable bucket having a second leading end portion;

a horizontal mounting plate connected to said top portion of said body bucket;

wherein said openable bucket is hinged to said body bucket by a hinge pin such that said body bucket and said openable bucket are openable and closeable relative to each other, said leading end portions being in engagement with each other when said body bucket and said openable bucket are closed relative to each other; and an actuating cylinder extending horizontally above said top portion of said body bucket and below said horizontal mounting plate so as to be between said top portion and said mounting plate, said actuating cylinder having a first hinged portion hinged to said body bucket and a second hinged portion hinged to said openable bucket, a line connecting said first and second hinged portions being substantially horizontal.

* * * * *